United States Patent [19]

Horton et al.

[11] 4,092,758

[45] June 6, 1978

[54] CAST POWER BRUSH

[75] Inventors: John P. Horton, Bernardsville; Susan H. LeWand, Colonia, both of N.J.

[73] Assignee: Newark Brush Company, Kenilworth, N.J.

[21] Appl. No.: 604,546

[22] Filed: Aug. 14, 1975

[51] Int. Cl.[2] ..... A46B 3/02; A46B 3/16

[52] U.S. Cl. ..... 15/180; 15/198; 15/DIG. 3; 300/21

[58] Field of Search ..... 15/180, 181, 182, 183, 15/190–200, DIG. 3; 300/21; 264/243

[56] References Cited

U.S. PATENT DOCUMENTS

| | | | |
|---|---|---|---|
| 1,042,393 | 10/1912 | Chandler | 15/194 |
| 1,826,234 | 10/1931 | Acheson | 15/194 |
| 2,283,293 | 5/1942 | Steiert | 15/200 |
| 2,591,331 | 4/1952 | Baumbach | 15/199 X |
| 2,604,362 | 7/1952 | Sugerman et al. | 15/DIG. 3 |
| 2,740,148 | 4/1956 | Nelson et al. | 15/DIG. 3 |
| 3,027,585 | 4/1962 | Freedman et al. | 15/28 X |
| 3,064,702 | 11/1962 | Coolidge et al. | 15/198 X |
| 3,071,795 | 1/1963 | Hartz et al. | 300/21 X |
| 3,111,699 | 11/1963 | Comeau | 15/200 X |
| 3,343,195 | 9/1967 | Menges | 15/198 X |
| 3,418,674 | 12/1968 | Lechene | 300/21 X |
| 3,875,607 | 4/1975 | Rosseau | 15/180 |

FOREIGN PATENT DOCUMENTS

| | | | |
|---|---|---|---|
| 591,887 | 1/1934 | Germany | 15/190 |
| 149,390 | 1962 | U.S.S.R. | 15/191 |

OTHER PUBLICATIONS

W. R. Grace & Co., N.J., *Polyester Resin* GR 17039, Technical Bulletin, Jan. 1973.

Reichhold Chemicals, Inc., N.Y., *Polyester Resin* 32–357 Polylite, Technical Bulletin, Sep. 1970.

*Primary Examiner*—Peter Feldman

*Attorney, Agent, or Firm*—Littlepage, Quaintance, Murphy, Richardson and Webner

[57] ABSTRACT

A brush element containing a plurality of bristles having medial bends formed into a plurality of tufts, each tuft being surrounded by a mechanical restraining means, a back for said brush comprising a body of fiberglass filled and reinforced substantially inflexible high impact thermoset polyester resin, each medial bend of said bristles being embedded in said resin such that its upper end is closer to the top surface of said back than to the bottom surface thereof and the restraining means being closer to the bottom surface of said back than to the top surface thereof. The polyester resin has a notched izod impact strength greater than 2 foot-pounds per inch and a Shore D hardness greater than 50.

7 Claims, 9 Drawing Figures

CAST POWER BRUSH

BACKGROUND OF THE INVENTION

1. Field of the Invention

This invention relates to rotary brushes for cleaning, polishing, scrubbing, and the like, whose working surface is a flat or disk shape. The working surface is formed from a plurality of bristles, that is, separate, usually artificial elements, arranged in near parallel relation such that their assembled ends constitute collectively the working surface. The invention particularly relates to such a brush having particular utility in municipal and industrial powered rotary operations.

2. Description of the Prior Art

In rotary driven brushes adapted for heavy industrial and municipal use, holders for the brush bristle material have typically been cast with a plurality of pairs of bristle-receiving passages extending through the holder from the top to the bottom. After the holder was cast, bites or tufts of U-shaped bristles were disposed in each pair of bristle-receiving passages to extend through the holder out to a working face. Examples of such holders are to be found in U.S. Pat. Nos. 3,526,919; 3,678,530 and 3,875,607. Rotary brushes of this construction suffer the distinct disadvantage of requiring considerable labor to ensure proper insertion of the bristle material into the holder after the holder was cast.

In some molded rotary brushes of this type, the apertures receiving the bristles did not extend all the way though the holder or brush back, but rather extended only part way through, as sockets to receive the brush bristle together with typically a staple holding the bristle tuft in place. Examples of brushes of this construction can be found in U.S. Pat. Nos. 2,539,211 and 3,310,827. Brushes of this configuration still required the time-consuming positioning and securing of the individual tufts in the sockets of the holder. Further, since in both of these configurations the brush bristle material is added after the brush back or holder is formed, it is easy for the bristle material to work free under the continuous buffeting and flexing experienced during operation of the brush.

In order to reduce the amount of time and effort expended in positioning the tufts of bristles into the appropriate apertures of a brush back or holder, attempts have been made to mold a body of plastic resin around the bristles, thereby securing the bristles once the molded body of resin is cured. While such a procedure has met with success in some instances, under the severe, heavy work experienced by heavy-duty rotary powered industrial and municipal brushes, the bristles repeatedly work themselves free from the molded body of resin. In order to overcome this difficulty, some brushes of this type have been made wherein the molded body of resin extends over a major portion of the bristle length and may extend all the way to the brush face. This severely restricts the bristle action desired for the proper cleaning, polishing and scrubbing action of the brush bristles. An example of a brush of this type is to be found in U.S. Pat. No. 3,404,422.

SUMMARY OF THE INVENTION

A brush made according to this invention consists generally of a plurality of bristles, typically steel, for example, high carbon, flat steel wire having transverse dimensions of about 0.025 in. × 0.125 in. In one embodiment, quantities of perhaps 15 to 50 strands of bristle material having a medial bend form a tuft. In one embodiment, a restraining means surrounds the bristles near the medial bend for mechanically restraining the tufts of bristles from leaving the brush. A substantially inflexible body of high impact resin is then molded in situ around the plurality of bristles. The restraining means is preferably substantially completely embedded in the body of resin.

The resin used is a resin capable of being cast, such that a major portion of each tuft extends out of the body of resin, the bristles present in each major portion being substantially free of the resin. In order to withstand the mechanical shock and vibration of heavy duty use in municipal and industrial operations, the resin should have a Shore "D" hardness of greater than 50 and preferably about 70. Further, the resin should have a notched izod impact strength of greater than 2 foot-pounds per inch and preferably greater than 6 foot-pounds per inch. An example of a resin fulfilling such requirements is a polyester resin such as POLYLITE 32-357, marketed by Reichhold Chemicals, Inc., of White Plains, N.Y., and Resin GR 17039, marketed by W. R. Grace and Company, Linden, N.J. Both of these resins, when filled to the manufacturer's recommendations with chopped fiberglass of about ⅛ to about ¼ in. in length, exceeds the hardness and impact strength requirements. A flexible material, such as a resilient natural or synthetic rubber, would not satisfy the requirements of this invention since the bristles would then be free to move away from the workpiece under even ordinary pressures. It is an object of this invention to desirably position the bristles of the brush so that their assemblance constitutes collectively a working surface for cleaning, polishing, scrubbing, et cetera.

It has been found in some instances that simply positioning straight bristles or tufts of bristles into a cast resin body results in a brush which will not perform satisfactorily when rotated at the high speeds typical of heavy industrial and municipal sweeping brushes. It has been found necessary then to include some mechanical restraining means for restraining tufts of bristles from leaving the brush under the high speed rotation, the restraining means being at least partly, and preferably completely, embedded in the body of resin. While any mechanical restraining means for performing the function intended might be satisfactory in certain circumstances, two particular embodiments of a restraining means have been found to be superior. A first embodiment of a superior restraining means consists of a plurality of rings, at least one ring surrounding each tuft near the medial bends of the bristles, the rings being substantially completely embedded in the body of resin. Yet another embodiment of a restraining means consists of a single plate fixed to all the tufts within the brush, the single plate being completely embedded in the body of resin. In each instance, a major portion of each tuft extends out of the body of resin with the bristles present in said major portion being substantially free of resin.

Further features and advantages of the invention will be apparent from the following description considered in connection with the accompanying drawings which form part of this specification.

DETAILED DESCRIPTION OF THE DRAWINGS

Figure 1:
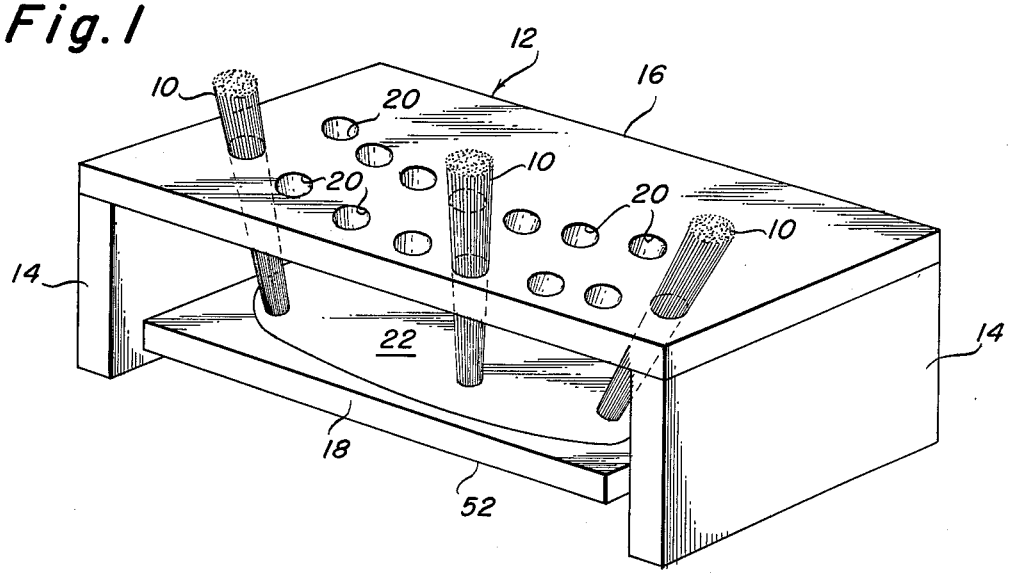
FIG. 1 shows a brush according to this invention in the process of being cast, including the mold and temporary bristle holder.

A brush according to this invention is preferably manufactured by supporting a plurality of bristles 10 of the desired bristle material in a tuft-supporting fixture 12, as illustrated in FIG. 1. The tuft-supporting fixture 12 as shown comprises generally a pair of side support members 14 supporting a top 16 in a desired location over a mold 18. The top 16 has a plurality of tuft-receiving holes 20 of the appropriate dimensions to receive the tufts 10. The tufts 10, when received in the bristle-receiving holes 20, are supported in such a manner and in such a direction as to depend into the mold 18. A casting resin, preferably a thermosetting polyester resin having the properties previously discussed, is then poured into the mold 18 to form the brush back 22.

The resin flows without the necessity of external pressure around and into each of the tufts 10 permeating any interstices between the bristles of each tuft to firmly fix the tufts 10 at the location and angle prescribed by the tuft-supporting fixture 12. The resin may extend up the bristles a short distance due to a slight capillary action, but a major portion of each tuft remains free from resin. The resin then cures and hardens into a unitary mass preferably having the physical properties previously discussed, thus forming a brush back 22. The mold 18 is preferably made of a material which will easily release the brush back 22 when cured. Flexible molds having the desired release characteristics have been formed from silicone rubbers, particularly the General Electric Room Temperature Vulcanizing Series of silicone rubbers. The use of flexible molds of this type permits the creation of a brush back having any desired exterior configuration.

Figure 2:
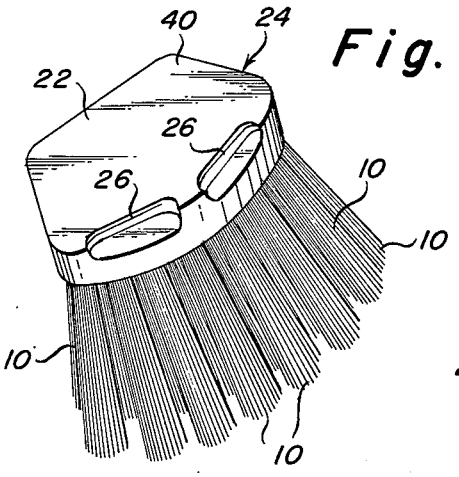
FIG. 2 is a perspective view, in reduced scale, of a brush resulting from the casting method illustrated in FIG. 1.

The completed brush 24 appears as illustrated in FIG. 2 when removed from the mold 18. The brush 24 comprises generally a brush back 22 formed of a substantially inflexible body of high impact resin molded around a plurality of tufts 10. The brush back can have appropriate apertures and recesses 26 for receiving an appropriate means for attaching the brush back to a motor power mechanism for power driven operation of the brush 24.

Figure 3:
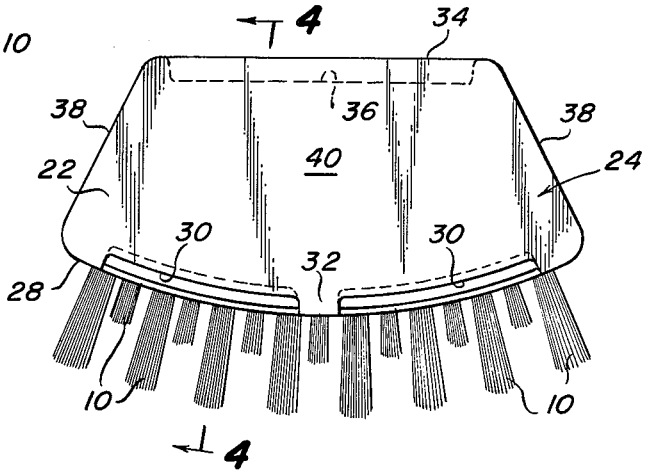
FIG. 3 is a top plan view of the brush illustrated in FIG. 2.

As shown in FIG. 3, the brush 24 has an outer, arcuate edge 28, including a pair of pockets 30 separated by a wall member 32. Opposite the outer arcuate edge is an inner linear edge 34 undercut by a cam groove 36 extending over a major portion of the inner linear edge 34. The two side walls 38 of the brush 24 joining the outer arcuate edge 28 and inner linear edge 34 lie substantially along radius vectors of the arc forming the outer arcuate edge 38. The top surface 40 of the brush 24 is substantially planar, as is the surface 42 out of which the tufts or bristles 10 protrude.

Figure 4:
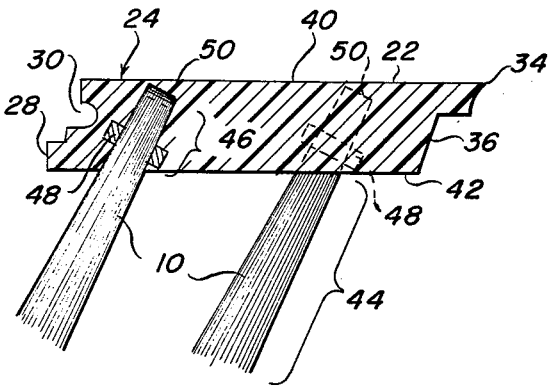
FIG. 4 is a sectional view of the brush shown in FIG. 3 cut along line 4—4 to illustrate one embodiment of the restraining means.

As shown in FIG. 4, the upper and lower surfaces 40 and 42, respectively, are substantially parallel. The bristles 10 protrude from the surface 42 at an angle, a major portion 44 of the tufts 10 extending out of the brush back 22, while only a minor portion 46 of the bristle is to be found embedded in the brush back 22. Each tuft 10 is surrounded by a restraining means 48 near the medial bend or bight 50 of the bristles, the restraining means 48 being substantially completely embedded in the body of resin forming the brush back 22. The particular restraining means 48 illustrated in FIG. 4 comprises a metal ring preferably of high strength steel surrounding each tuft 10. During the molding process, the tuft 10 is so positioned that the bight 50 of the strands forming the tuft is solidly against the bottom 52 of the mold 18 shown in FIG. 1. The restraining means 48, on the other hand, is so positioned with respect to the bight 50 that it is just underneath the surface 42 of the brush back 22. In this way, the working vibration experienced by the tufts of bristles 10 during operation of the brush acts to a major extent on the restraining means 48 and only to a minor extent on the surrounding mass of resin forming the brush back 22.

Figure 5:
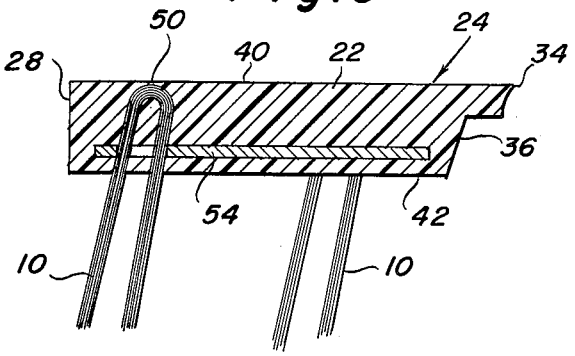
FIG. 5 is a sectional view of the brush shown in FIG. 3 showing a second embodiment of a restraining means.

FIG. 5 shows the same brush utilizing yet another restraining means 54 which consists of a single, unitary plate, into which the tufts of bristles 10 have been inserted. During the molding process, the bight 50 of the tufts of bristles 10 are positioned against the bottom of the mold 52 so as to be immediately adjacent to the upper surface 40 of the brush back 22.

The restraining means 54 is so positioned with respect to the bight 50 of the bristles that the restraining means is completely embedded in the body of resin, yet remains closer to the surface 42 out of which the tufts tend to protrude so as to absorb a major portion of the working vibration introduced into the tufts of bristles 10 when the brush is in use.

Figure 6:
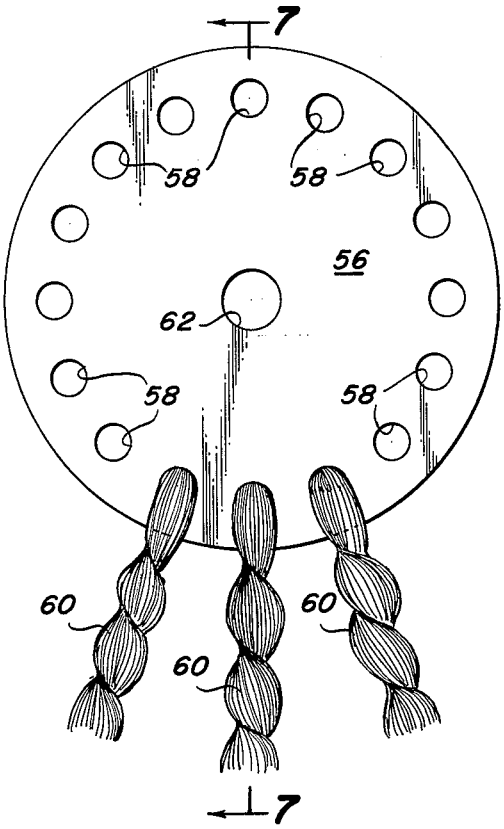
FIG. 6 is a plan view of a restraining means together with some tufts of bristles utilized to form a brush according to this invention.

A similar plate-like restraining means is illustrated in FIG. 6 by the disk member 56 which has a plurality of apertures 58 approximately equally spaced around the perimeter of the plate. In each of the apertures 58 is located a tuft 60 of bristles formed from a section of steel wire rope cut to an appropriate length, inserted through the apertures 58, and wrapped a turn or two to secure the tuft to the plate 56. The plate 56 further has a central aperture 62 for receiving an appropriate means for driving the brush to be formed in powered rotary motion.

Figure 7:
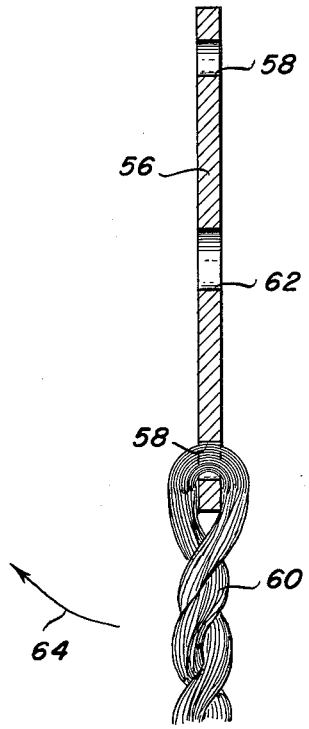
FIG. 7 is a sectional view of the restraining means and tufts of bristles illustrated in FIG. 6 cut along line 7—7.
Figure 8:
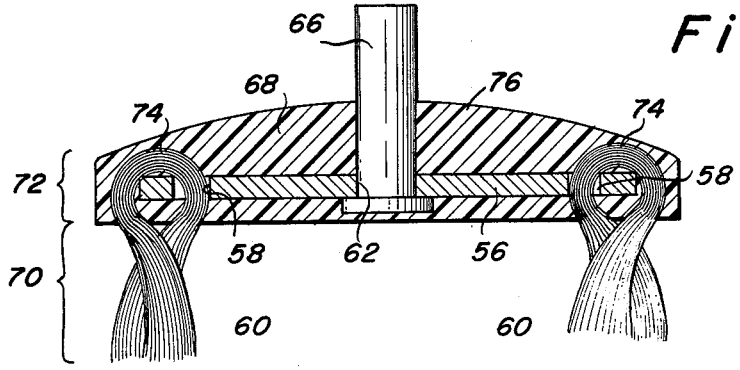
FIG. 8 is the same sectional view of the restraining means illustrated in FIG. 7 with the tufts of bristles turned at 90° and the bristles and restraining means encapsulated within a resin to form a brush according to this invention.

FIG. 7 illustrate the diskoid member 56 in section cut along lines 7—7. The tufts of bristles 60 which are initially positioned radially with respect to the diskoid member 56 are rotated in the direction of arrow 64 to assume a position approximately normal to the diskoid member 56. A driving pin 66 is inserted in the central aperture 62, as illustrated in FIG. 8 in a direction opposite from that of the projections of the tufts 60. The restraining means 56, driving pin 66 and tufts 60 are then placed in an appropriately shaped mold in a body 68 of substantially inflexible, high impact resin which is molded in situ such that a major portion 70 of the tufts 60 extends free from the body of resin, while a minor portion 72 of the tufts 60 is encapsulated along with the restraining means in the body of resin. The bight 74 of the tufts 60 are positioned immediately adjacent the upper surface 76 of the body of resin 68, while the restraining means 56 is located closer to the lower surface 78 than to the upper surface 76.

Figure 9:
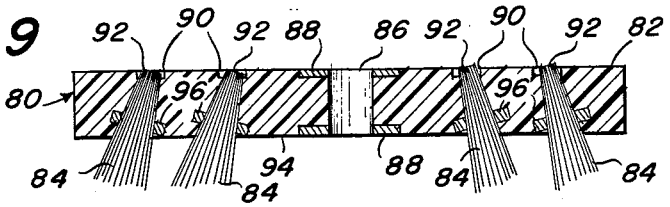
FIG. 9 is a sectional view of yet another brush according to this invention utilizing a restraining means substantially the same as that illustrated in FIG. 4.

The brush 80 illustrated in FIG. 9 comprises a unitary cast diskoid back 82 of substantially inflexible high impact resin. The resin is cast around a plurality of tufts 84 such that a major portion of each tuft extends out of the body of resin 82, the bristles in the major portion of each tuft being substantially free of resin. The brush 80 has a central bore 86 faced on each side with bushings 88 which can include appropriate slots and holes adapted to receive in locking engagement a shaft for driving the brush in rotary motion. The brush further comprises a plurality of annular recesses 90 coaxial with the bore 86. The bight or medial bend 92 of the bristles forming the tufts 84 is slightly exposed by the annular recess 90. The tufts 84 extend from the annular recess through the body 82 of resin and protrude outward from a lower surface 94, only a minor portion of each tuft 84 being held between the annular recesses 90 and lower surface 94. A restraining means 96 surrounds each tuft 84 in a manner substantially the same as that illustrated in FIG. 4.

Although the invention has been described in considerable detail with reference to certain preferred embodiments thereof, it will be understood that variations and modifications can be effected within the spirit and scope of the invention as described above and as defined in the appended claims.

What is claimed is:

1. In a rotary power driven high speed, heavy-duty municipal sweeping brush element having a working surface that is flat or disc shaped and provided with means for attaching the brush to a rotary heavy-duty source of power, said brush element containing a multiplicity of bristles having medial bends therein formed into a plurality of tufts containing a plurality of bristles, each tuft being surrounded by a mechanical restraining means so that a bight is formed in each of the tufts above said restraining means and so that the major portion of the bristles extend below said restraining means to perform the sweeping function, and a back for said brush and a positioning means for said tufts comprising a body of a fiberglass filled and reinforced substantially inflexible high impact thermoset polyester resin having a notched izod impact strength greater than 2 foot-pounds per inch and a Shore D hardness greater than 50 cast around said tufts so that said bight is embedded in said resin with its upper end closer to the top surface of said brush back than to the bottom surface thereof and with said restraining means being closer to the bottom surface of said back than to the top surface thereof and at least substantially completely embedded in the body of said resin.

2. The brush of claim 1 wherein the body of high impact resin comprises a casting resin filled with chopped fiberglass which, when cured, has a Shore "D" hardness of about 70 and a notched izod impact strength greater than about 6 foot-pounds per inch.

3. The brush of claim 1 wherein the restraining means comprises a plurality of rings, at least one ring surrounding each tuft.

4. The brush of claim 1 wherein the restraining means comprises a single plate fixed to all the tufts within the brush.

5. The brush element of claim 1 wherein the restraining means is a rigid member and the bristles are metal wire.

6. The brush element of claim 5 where the restraining means is plate metal and the wire is flat.

7. The brush element of claim 1 wherein the top and bottom of the brush back are substantially planar and substantially parallel.

* * * * *